US012480241B2

(12) United States Patent
Akahane et al.

(10) Patent No.: US 12,480,241 B2
(45) Date of Patent: Nov. 25, 2025

(54) SEWING MACHINE

(71) Applicant: JANOME Corporation, Tokyo (JP)

(72) Inventors: Kentaro Akahane, Tokyo (JP); Jun Mafune, Tokyo (JP)

(73) Assignee: JANOME CORPORATION, Tokyo (JP)

( * ) Notice: Subject to any disclaimer, the term of this patent is extended or adjusted under 35 U.S.C. 154(b) by 0 days.

(21) Appl. No.: 18/641,486

(22) Filed: Apr. 22, 2024

(65) Prior Publication Data

US 2024/0384453 A1 Nov. 21, 2024

(30) Foreign Application Priority Data

May 16, 2023 (JP) ..... 2023-080865

(51) Int. Cl.
*D05B 19/14* (2006.01)
*D05B 69/12* (2006.01)

(52) U.S. Cl.
CPC ..... *D05B 19/14* (2013.01); *D05B 69/12* (2013.01); *D05D 2205/14* (2013.01); *D05D 2205/16* (2013.01)

(58) Field of Classification Search
CPC ..... D05B 19/12; D05B 19/14; D05B 69/12; D05D 2205/14; D05D 2205/16
See application file for complete search history.

(56) References Cited

U.S. PATENT DOCUMENTS 5,899,158 A * 5/1999 Yoshida ..... D05B 19/12 112/102.5
2005/0016428 A1* 1/2005 Koerner ..... D05B 69/14 112/117
2018/0066387 A1* 3/2018 Zickenberg ..... D05B 19/12
2018/0195220 A1 7/2018 Imano et al.
2018/0347087 A1* 12/2018 Imano ..... D05B 1/00

FOREIGN PATENT DOCUMENTS

JP 2018-110608 A 7/2018

* cited by examiner

*Primary Examiner* — Nathan E Durham
(74) *Attorney, Agent, or Firm* — MATTINGLY & MALUR, PC

(57) ABSTRACT

A sewing machine includes a sewing pitch setup unit configured to set up a given sewing pitch; a movement detection unit configured to detect a movement of a material to be sewn; a control unit configured to calculate a movement speed of the material on the basis of a movement amount of the material detected by the movement detection unit and to calculate a rotational rate for a sewing machine motor for operating a needle on the basis of the movement speed and the given sewing pitch; and an informing component configured to inform of magnitude of the rotational rate relative to a maximum rotational rate for the sewing machine motor.

7 Claims, 8 Drawing Sheets

SEWING MACHINE

CROSS-REFERENCE TO RELATED APPLICATION

The present application claims priority from Japanese application JP2023-080865, filed on May 16, 2023, the content of which is hereby incorporated by reference into this application.

TECHNICAL FIELD

The disclosure relates to a sewing machine.

BACKGROUND

There is known a sewing machine operable to carry out the sewing method called "free motion", in which a user can perform sewing by moving a material to be sewn in user's own way while an automatic feed mechanism of the sewing machine is not used for feeding the material. This sewing machine may be configured to perform sewing at a predetermined sewing pitch in such a way that the sewing machine detects movements of a material to be sewn as moved by a user and controls a sewing speed (a rotational rate of a sewing machine motor for operating a needle) in accordance with the detected movement speed.

In this regard, for example, Patent Document 1 discloses the sewing machine having improved movement detection accuracy. In this sewing machine, a detection period of a device for detecting movements of a material to be sewn is adjustable in accordance with a movement amount of the material per unit time in order to reduce noise effect.

RELATED ART DOCUMENTS

Patent Documents

Patent Document 1: JP 2018-110608 A

In the free motion sewing technology as disclosed in Patent Document 1, if a user moves a material to be sewn too fast, the follow-up control of the sewing speed fails to function properly and a designated sewing pitch is not achieved even if the detection period is adjusted, and as a result the sewing pitch may be disturbed. In other words, a movement speed of a material to be sewn has an upper limit for follow-up. For this reason, it is necessary to move the material at a movement speed not exceeding the maximum movement speed. However, the conventional sewing machine has no means for allowing a user to grasp a sewing speed of a currently moved material.

SUMMARY

As an example, the concepts according to the accompanying claims are adopted for solving the problem above. The present application includes a plurality of means and methods for solving the problem above. As an example thereof, the disclosure relates to a sewing machine. This sewing machine includes: a sewing pitch setup unit configured to set up a given sewing pitch; a movement detection unit configured to detect a movement of a material to be sewn; a control unit configured to calculate a movement speed of the material on the basis of a movement amount of the material detected by the movement detection unit and to calculate a rotational rate for a sewing machine motor for operating a needle on the basis of the movement speed and the given sewing pitch; and an informing component configured to inform of magnitude of the rotational rate relative to a maximum rotational rate for the sewing machine motor.

This sewing machine allows a user to grasp a current sewing speed. Other aspects of the disclosure are disclosed in the following description of embodiments.

EMBODIMENTS

Hereinafter, embodiments of the disclosure will be described in conjunction with illustrative examples.

Figure 1:
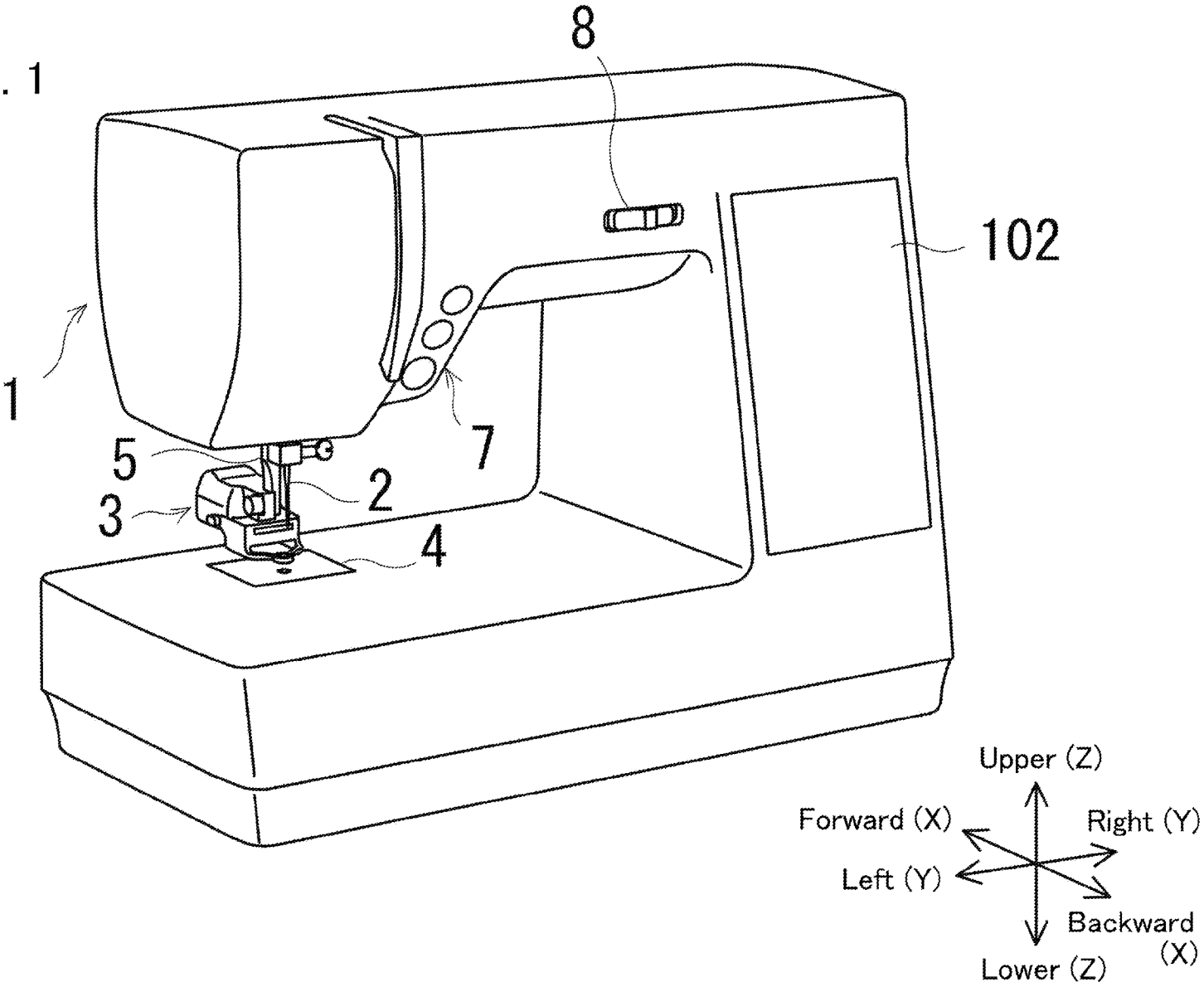
FIG. 1 shows an exemplary diagram of an embodiment of a sewing machine.

FIG. 1 shows an embodiment of a sewing machine. A sewing machine 1 operates a needle 2 through the well-known linkage by a built-in sewing machine motor (not shown). The sewing machine 1 performs a sewing operation in synchronization with a movement of a material to be sewn (not shown) when the material is pressed by a presser 3 and moved by a user (free motion sewing). In the sewing operation, an upper thread and a lower thread (not shown) are crossed to form a seam on the material. The upper thread is fed from a thread pool (not shown) and threaded through the needle 2. The lower thread is stored in a bobbin (not shown) placed inside the sewing machine 1. The material (for example, a cloth) is held between the presser 3 and a needle plate 4. The needle 2 is moved down by operation of the sewing machine motor and then penetrates the material to come close to the bobbin. The upper and lower threads are crossed by operation of a hook (not shown). Subsequently, the needle 2 moves up and comes out of the material and then a stitch is formed. In normal sewing that is not a free motion, the material is automatically fed forward at a predetermined distance by operation of an automatic feed mechanism (not shown), and then the next stitch is formed in the same manner. By repetition of this process, a straight unbroken sewing pattern with stitches at predetermined intervals is formed on the material. The distances between the stitches are referred to as "sewing pitch".

Figure 2:
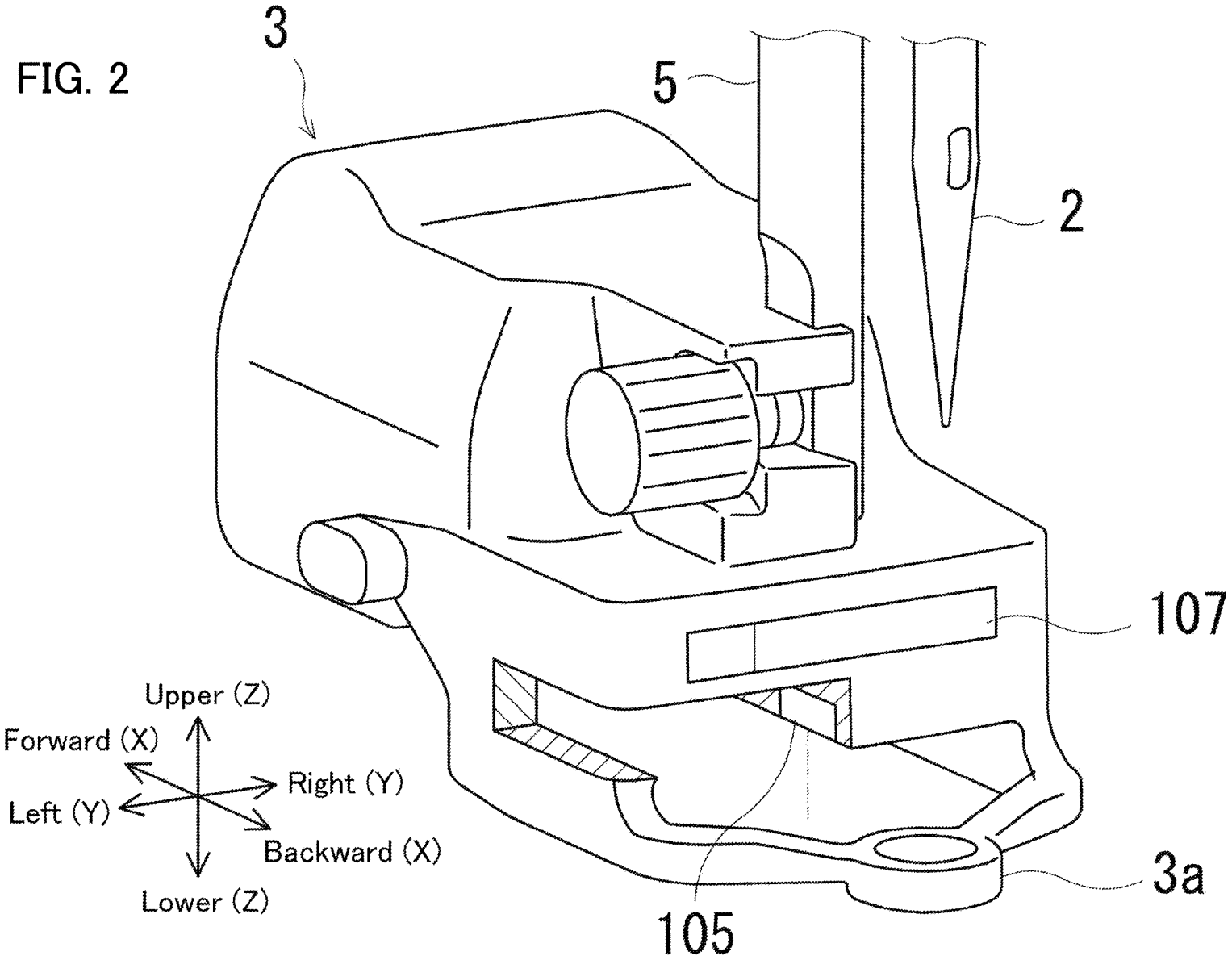
FIG. 2 shows an exemplary diagram of an enlarged view with a partial cross-section of a presser of the sewing machine illustrated in FIG. 1.

In free motion sewing, a user conducts a sewing operation of the sewing machine 1, in which the user manually moves a material to be sewn without using the above-described automatic feed mechanism of the sewing machine 1, in order to form a desired sewing pattern, such as a curved line. The presser 3 shown in FIG. 1 is a suitable presser for this free motion sewing. FIG. 2 shows an enlarged view of the presser 3 in this embodiment. In FIG. 2, for illustration purpose, the presser 3 is depicted in a partial cross-sectional view (hatched sections).

The presser 3 is provided with a pressing part 3*a* having a circular hole. The material is placed between the pressing part 3*a* and the needle plate 4, and then the needle 2 is moved down through the hole of the pressing part 3*a* and stuck into the material. The pressing part 3*a* does not block the vertical movement of the needle 2 and it is positioned on the material at the periphery of the sticking point of the needle 2. This allows a vertical vibration of the material caused by the vertical movement of the needle 2 to be controlled and thus facilitates the formation of an assured seam. The presser 3 is attached to a presser bar 5 movable vertically in accordance with operation of the needle 2. The presser 3 is detachable for replacement with a presser for normal sewing. A suitable presser is selectable when the mode of the sewing machine 1 is switched between normal sewing and free motion sewing.

As illustrated in FIG. 2, a movement detection unit 105 is incorporated in the presser 3. The movement detection unit 105 for detecting movements of the material is configured with, for example, an image sensor. The movement detection unit 105 implements image processing of image data acquired by the image sensor imaging the surface of the material to obtain information on the movement of the material. Alternatively, an optical sensor may be used. The optical sensor may detect a surface profile of the material using visible light, infrared light, etc. to determine a movement amount of the material. In a further example, a movement detection unit may be provided with a built-in trackball in contact with the material so that a movement amount of the material is determined on the basis of rolling of the trackball according to a movement of the material.

In this embodiment, the movement detection unit 105 is incorporated in the detachable presser 3. However, in another example, the movement detection unit 105 may be provided in the body of the sewing machine 1. Moreover, the movement detection unit 105 is arranged over the material in this embodiment. However, in another example, the movement detection unit 105 may be arranged under the material.

The sewing machine 1 is provided with a start-stop key 7, a speed controller 8, a display 102 comprising a touch panel, at respective accessible positions for a user. The start-stop key 7 is used for starting/stopping a sewing operation and, in this embodiment, comprises push buttons. The speed controller 8 comprises a slidable knob in this embodiment, which is an analog device having a variable output according to a position of the knob slid laterally by a user. The slidable knob is illustrated in this embodiment. In another example, a rotatable knob may be used for the speed controller 8. Alternatively, the speed controller 8 may comprise a digital device, which implements digital signal processing of an input. In this embodiment, the display 102 comprises a liquid crystal panel display with a touch panel function. The display 102 displays functional and operational conditions of the sewing machine 1. The display 102 is also used for touch inputs of various parameters using a setup screen or the like. In particular, in this embodiment, a user may input a sewing pitch setting by touching a predetermined section of the display 102 which is displaying the setup screen.

In addition, a foot controller (not shown) is connectable to the sewing machine 1 via an input-output terminal. The foot controller may be configured to start a sewing operation by pressing, stop the sewing operation by releasing, and regulate a sewing speed in accordance with an amount of pressure.

In this embodiment, as illustrated in FIG. 2, an informing component 107 is provided at the front of the presser 3 (the surface facing a user). In this embodiment, the informing component 107 comprises a horizontally-long rectangular indicator including light emitting devices (LED) horizontally arranged in a line in order to improve viewability for a user. In other examples, the informing component 107 may comprise a speaker for informing with sound or a combination of an indicator for vision and a speaker for hearing, etc.

Embodiment of the Control Unit

Figure 3:
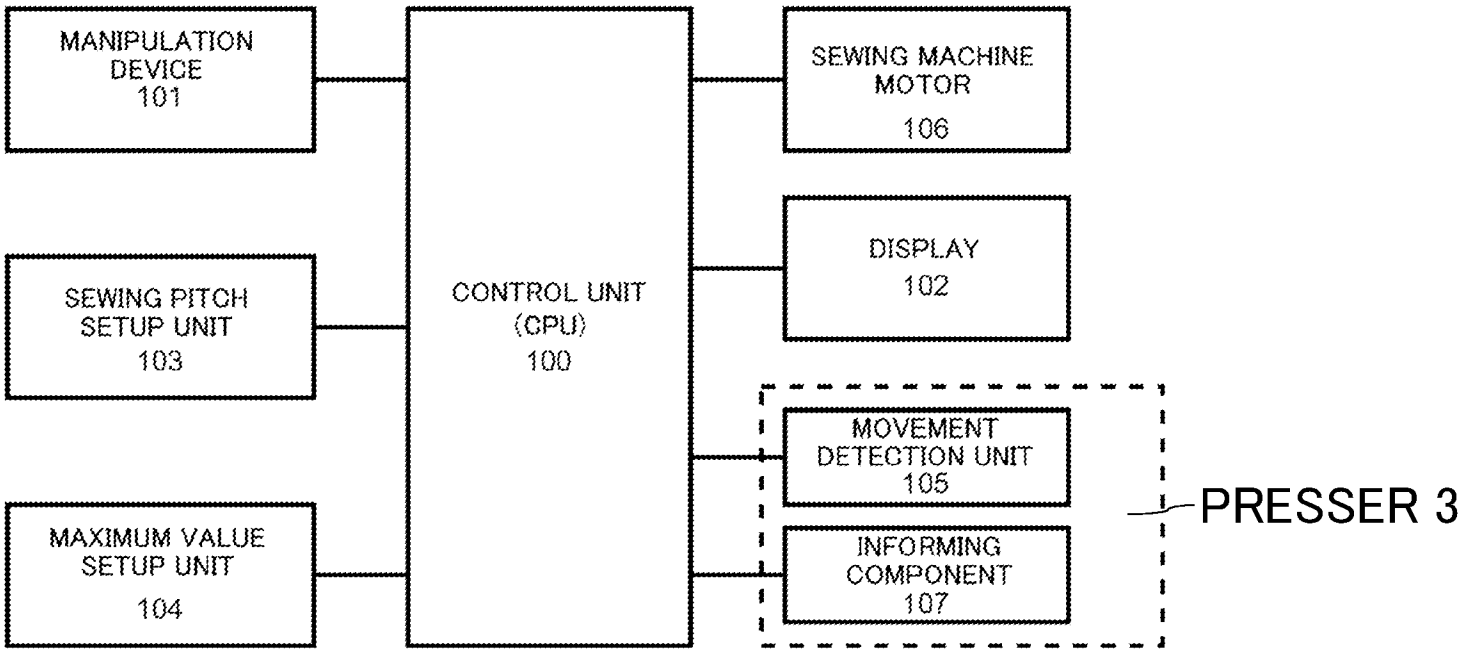
FIG. 3 shows an exemplary block diagram of an embodiment of a control unit.

FIG. 3 shows a block diagram of an embodiment of a control unit 100 on the sewing machine 1, which is configured to control a sewing operation. The control unit 100 consists of a processor (CPU) comprising, for example, ASIC (Application Specific Integrated Circuit), FPGA (Field-Programmable Gate Array), or PLC (Programmable Logic Controller). The control unit 100 controls a sewing operation when implementing a computer program stored in an external or internal memory.

The control unit 100 controls a manipulation device 101 and the display 102, and receives signals from the manipulation device 101 and the display 102. The manipulation device 101 includes the start-stop key 7, the speed controller 8, and the foot controller as described above. A sewing pitch setup unit 103, a maximum value setup unit 104, and the movement detection unit 105 are connected to the control unit 100. A maximum value of a rotational rate for a sewing machine motor 106, as described below, is set up and stored in the maximum value setup unit 104. A sewing pitch P selected by a user may be set up and stored in the sewing pitch setup unit 103. The sewing pitch P may be set up before the start of sewing by means of the manipulation device 101.

The control unit 100 operates the sewing machine motor 106 for driving the needle 2 and the informing component 107 in cooperation with the devices and units above. In this embodiment, the movement detection unit 105 and the informing component 107 are incorporated in the presser 3 as illustrated in FIG. 2. At least the sewing pitch setup unit 103 and the maximum value setup unit 104 may be composed using software modules or hardware modules in the control unit 100, or may be provided as devices separate from the control unit 100.

Embodiment of the Informing Component

Figure 4:
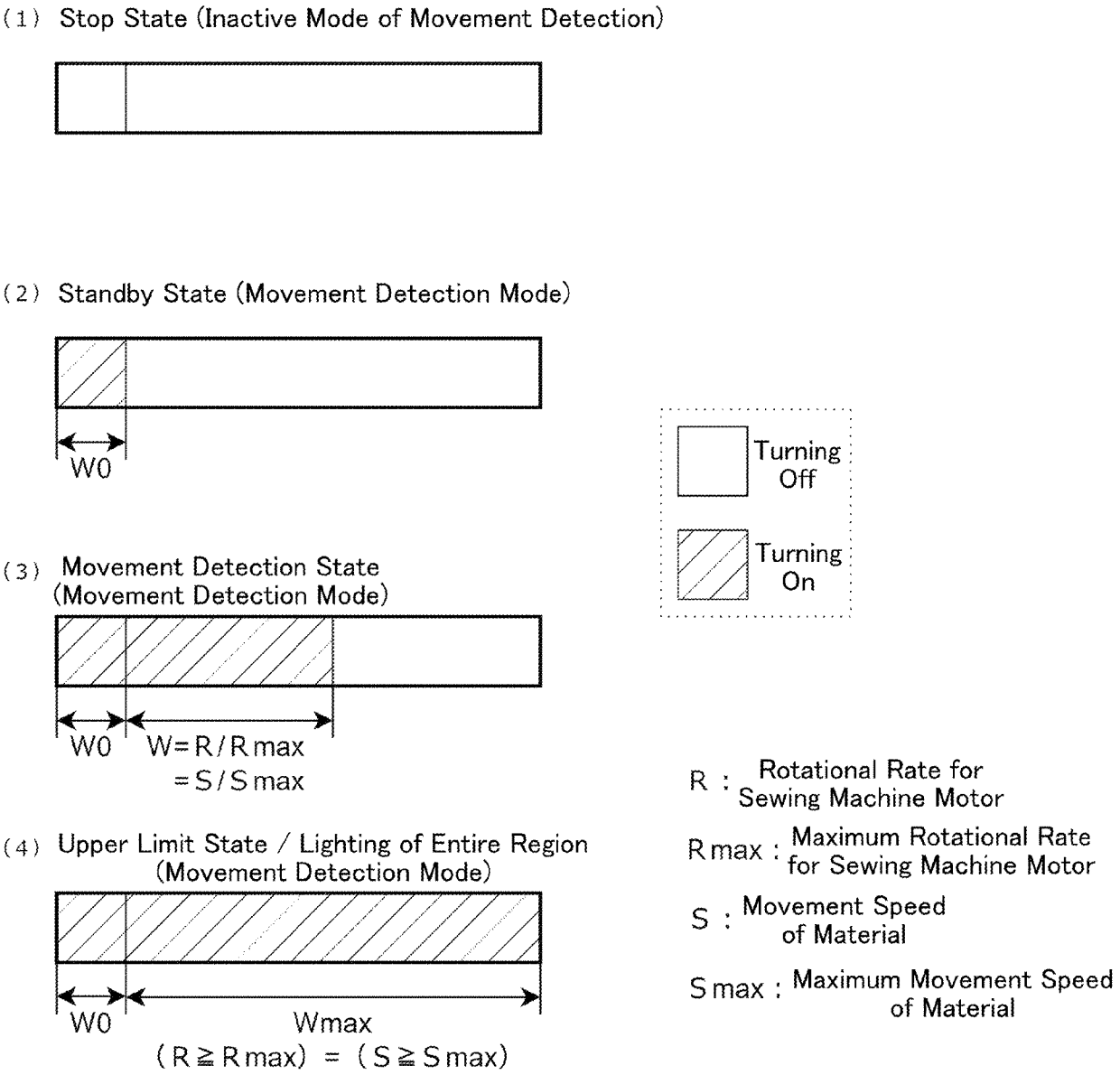
FIG. 4 shows an exemplary diagram of an embodiment of an informing component.

FIG. 4 shows an embodiment of the informing component 107. The informing component 107 according to this first embodiment comprises a horizontally-long rectangular indicator consisting of light emitting elements arranged horizontally, which is mounted, for example, on the front side of the presser 3 for user viewability. The informing component 107 displays information as to a current movement speed of the material, information as to a maximum movement speed for the material, and information as to a current mode of the sewing machine 1 to a user in a visual manner by means of turning off/turning on/light region variation.

In FIG. 4, State (1) represents a stop state of the sewing machine 1, in which the sewing machine 1 is put in an inactive mode of movement detection. In this inactive mode, the movement detection of the material by the movement detection unit 105 is disabled. The entire region of the informing component 107 is turned off to inform a user that the sewing machine 1 is put in the stop state.

State (2) represents a standby state, in which the user manipulates, for example, the start-stop key 7 of the manipulation device 101 and then the sewing machine 1 is put in the standby state, where the sewing machine 1 is ready to start an operation (free motion sewing). Although a movement detection mode for detecting movements of the material by the movement detection unit 105 has been started, the user does not move the material yet. The control unit 100 partially turns on only the initial region W0 of the informing component 107. Turning on only the initial region W0 of the informing component 107 informs the user that the free motion sewing is ready for operation and the sewing machine 1 is put in the standby state.

State (3) represents a movement detection state, in which the user moves the material to start the free motion sewing. The movement detection unit 105 detects the movement of the material. The control unit 100 receives the detection signal and calculates a rotational rate R for the sewing machine motor 106 as described below. The control unit 100 turns on the speed monitoring region W=R/Rmax of the informing component 107 proportional to R/Rmax that indicates the magnitude of the rotational rate R relative to a preset maximum rotational rate Rmax for the sewing machine motor 106 (as a result, the light region is "W0+R/Rmax"). The rotational rate R for the sewing machine motor 106 is calculated from a movement speed S of the material and the sewing pitch P. A maximum movement speed Smax is calculated from the maximum rotational rate Rmax for the sewing machine motor 106 and the sewing pitch P. The sewing pitch P is preset as a sewing condition on the sewing pitch setup unit 103 prior to the start of sewing. Accordingly, the rotational rate R can be derived uniquely from the calculated movement speed S during sewing. The maximum movement speed Smax can be derived uniquely from the preset maximum rotational rate Rmax. The respective ratios W=R/Rmax and W=S/Smax (the speed monitoring region) are equivalent in value to each other. Thus, the speed monitoring region W=R/Rmax indicates also the magnitude (ratio) of the movement speed S of the material relative to the maximum movement speed Smax. As a result, the user can easily grasp in a visual manner variations in the movement speed S of the material being moved by the user, in particular, the current ratio of the movement speed S relative to the maximum movement speed Smax.

State (4) represents an upper limit state, in which the maximum movement speed is detected. This display state indicates that the user moves the material at a speed equal to or more than the maximum movement speed Smax. As described above, the maximum movement speed Smax, which is calculated from the maximum rotational rate Rmax for the sewing machine motor 106 and the sewing pitch P, may be also considered as the upper limit of the movement speed S of the material, where it is possible to maintain the sewing pitch P at a speed range less than or equal to the upper limit. If the user moves the material at the maximum movement speed Smax or more, the sewing fails to maintain the preset sewing pitch P because the control unit 100 is unable to operate the sewing machine motor 106 at the maximum rotational rate Rmax or more. In view of this, when the movement speed S of the material calculated on the basis of the detection signal from the movement detection unit 105 reaches the maximum movement speed Smax or more, the control unit 100 turns on the region Wmax=S≥Smax of the informing component 107 (as a result, the light region is "W0+Wmax", which is the entire region of the informing component 107). The user is thereby informed that the movement speed S of the material exceeds the maximum movement speed Smax and the sewing fails to maintain the preset sewing pitch P.

In the embodiment of the informing component 107 described above, the horizontally-long rectangular indicator for visual display comprising a plurality of light emitting elements is exemplarily described. In another example, an indicator may be configured to visually display by means of interval of blinking of one or more light emitting element. In this example, the indicator may be operated as follows: (1) turning off in the stop state; (2) in the standby state, blinking at a maximum interval (slowest blinking); (3) in the movement detection state, blinking at different intervals in accordance with the detected movement speed S (the rate of blinking is variable); (4) in the upper limit state, continuously turning on (lighting without blinking) or changing light color. In other examples, the informing component 107 may comprise a speaker for informing the movement speed S by changes in sound. In this example, the speaker may be operated as follows: (1) silence in the stop state; (2) in the standby state, sounding at a maximum interval (e.g., "beep - - - beep - - - beep": repetition of one beep sound at a maximum interval); (3) in the movement detection state, sounding at different intervals in accordance with the detected movement speed S (e.g., "beep-beep-beep": repetition of one beep sound at gradually reduced intervals as the speed is increased, and a long beep sound just before reaching the maximum movement speed); (4) sin the upper limit state, changing the sound to a different sound (e.g., changing to a buzzer sound).

In this embodiment, the informing component 107 is mounted on the presser 3. In another example, the informing component 107 may be displayed on the display 102. In other examples, the informing component 107 may be provided on a suitable location for user viewability. For example, if the informing component 107 is displayed on the display 102, the variable light region as illustrated in the figures may be displayed, or the rotational rate of the sewing machine motor or the movement speed of the material may be numerically displayed, or a pointer may be displayed in a rotational manner as in a speedometer of a vehicle.

An exemplary control process for free motion sewing curried out by the control unit 100 using the informing component 107 as described above will be described in reference to the exemplary flowcharts shown in FIG. 5 to FIG. 8.

Embodiment 1 of a Control Process by the Control Unit

Figure 5:
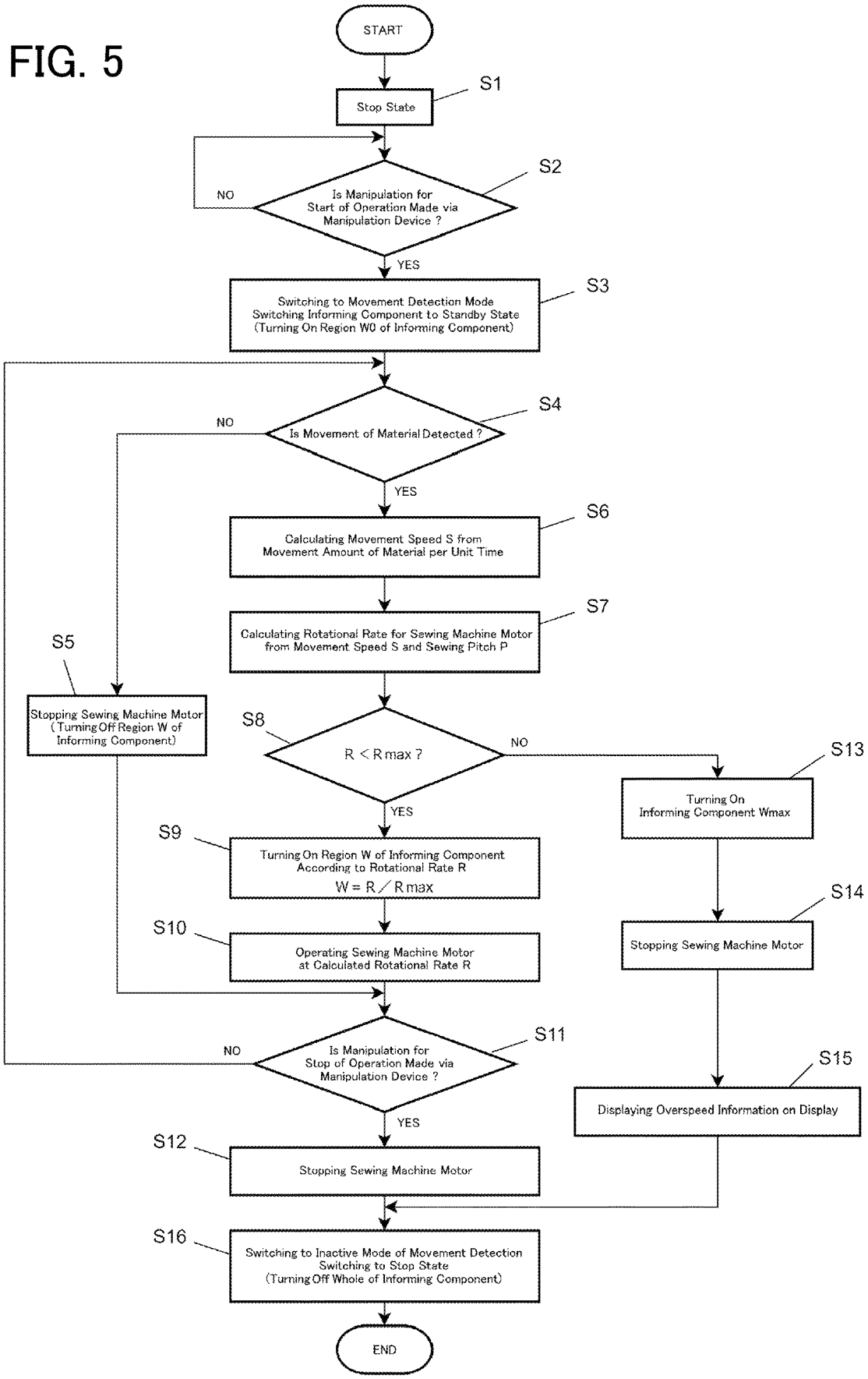
FIG. 5 shows an exemplary flowchart of Embodiment 1 of a control process implemented by the control unit.

FIG. 5 shows a flowchart illustrating a control process according to Embodiment 1. START: The sewing machine 1 is powered on, but the sewing machine 1 is put in the stop state at Step S1 before a user conducts a start operation for free motion sewing. The control unit 100 is put in the inactive mode of movement detection, where the movement detection of a material to be sewn using the movement detection unit 105 is not implemented. The control unit 100 turns off the informing component 107 in the entire region thereof ((1) shown in FIG. 4) in order to inform the user that the sewing machine 1 is put in the stop state.

At Step S2, the control unit 100 monitors whether a manipulation for the start of operation is made via the manipulation device 101. For example, the control unit 100 may monitor whether the start-stop key 7 of the manipulation device 101 is manipulated. The manipulation for the start of operation via the manipulation device 101 is not limited to the manipulation of the start-stop key 7, e.g., pushing its button. In another example, pressing the foot controller may be detected as the manipulation for the start of operation. If the manipulation for the start of operation is not detected (NO), Step S2 is repeated. If the manipulation for the start of operation via the manipulation device 101 is detected (YES), the control unit 100 switches to the movement detection mode at Step S3 and then starts the movement detection of the material by means of the movement detection unit 105. At Step S3, the sewing machine 1 is ready to start sewing, but the user has not yet moved the material. Thus, the control unit 100 does not operate the sewing machine motor 106 yet while putting the informing component 107 in the standby state. The informing component 107 is controlled such that it is partially turned on at its initial region W0 ((2) shown in FIG. 4) in order to inform the user of standby for sewing.

After putting the informing component 107 in the standby state, the control unit 100 monitors a movement of the material by means of the movement detection unit 105 at Step S4. If any movement of the material is not detected by means of the movement detection unit 105 (NO), the control unit 100 stops the sewing machine motor 106 and turns off the region W of the informing component 107, at Step S5. In this embodiment, at Step S5, the sewing machine motor 106 is stopped. In another example of Step S5, the sewing machine motor 106 may be operated at a very-low rotational rate (a stroke of the needle is made about per second). This operation at the very-low rotational rate allows for a finishing stitch, etc. If a movement of the material is detected by means of the movement detection unit 105 at Step S4 (YES), the control unit 100, at Step S6, acquires a movement amount of the material per unit time from the detection signal of the movement detection unit 105 and then calculates the movement speed S of the material on the basis of the movement amount. At Step S7, the control unit 100 calculates the rotational rate R for the sewing machine motor 106 from the calculated movement speed S and the sewing pitch P preset by the sewing pitch setup unit 103.

After calculating the rotational rate R, at Step S8, the control unit 100 acquires the maximum rotational rate Rmax and then monitors whether the rotational rate R reaches the maximum rotational rate Rmax (R<Rmax). The maximum rotational rate Rmax for the sewing machine motor 106 is a maximum rate for the free motion sewing by the sewing machine according to this embodiment. In an example, a rotational rate corresponding to the hardware limitations of the sewing machine motor 106 (responsiveness, etc.) may be preset on the control unit as the maximum rotational rate Rmax. Alternatively, a maximum rotational rate based on the user's skill or the like, which is preset by the user and stored on the maximum value setup unit, may be employed as the maximum rotational rate Rmax.

At Step S8, if the calculated rotational rate R does not reach the maximum rotational rate Rmax (YES), the control unit 100, at Step S9, turns on the speed monitoring region W=R/Rmax of the informing component 107 in accordance with the rotational rate R ((3) shown in FIG. 4). Subsequently, the control unit 100, at Step S10, operates the sewing machine motor 106 on the basis of the rotational rate R calculated at Step S7. Then, at Step S11, the control unit 100 monitors whether a manipulation for the stop of operation is made via the manipulation device 101 by the user. For example, the manipulation for the stop of operation via the manipulation device 101 may be made by means of manipulating the start-stop key 7 (pushing its button) or releasing the foot controller. If the manipulation for the stop of operation is not detected (NO), the control unit 100 carries out repeatedly the steps following Step S4. If the manipulation for the stop of operation is detected (YES), the control unit 100 implements a stop operation for the sewing machine motor 106 at Step S12.

At Step S8, if the rotational rate R reaches or exceeds the maximum rotational rate Rmax (NO), the control unit 100, at Step S13, turns on the whole (Wmax) of the speed monitoring region W, and as a result, the entire region W0+Wmax of the informing component 107 is turned on ((4) shown in FIG. 4). Subsequently, the control unit 100 implements a stop control for the sewing machine motor 106 at Step S14. Then, in an example, overspeed information is displayed on the display 102 at Step S15. The user is thereby informed that the speed for moving the material is too fast. This control process allows the user to stop the sewing before the seam becomes uneven. After stopping the sewing machine motor 106 at either Step S12 or S14, the control unit 100, at Step S16, switches the movement detection mode for detecting movements of the material by the movement detection unit 105 to the inactive mode of movement detection. In addition, the control unit 100 puts the sewing machine 1 in the stop state and turns off the whole of the informing component 107 ((1) shown in FIG. 4), thereby informing the user that the sewing machine 1 is stopped.

Embodiment 2 of a Control Process by the Control Unit

Figure 6:
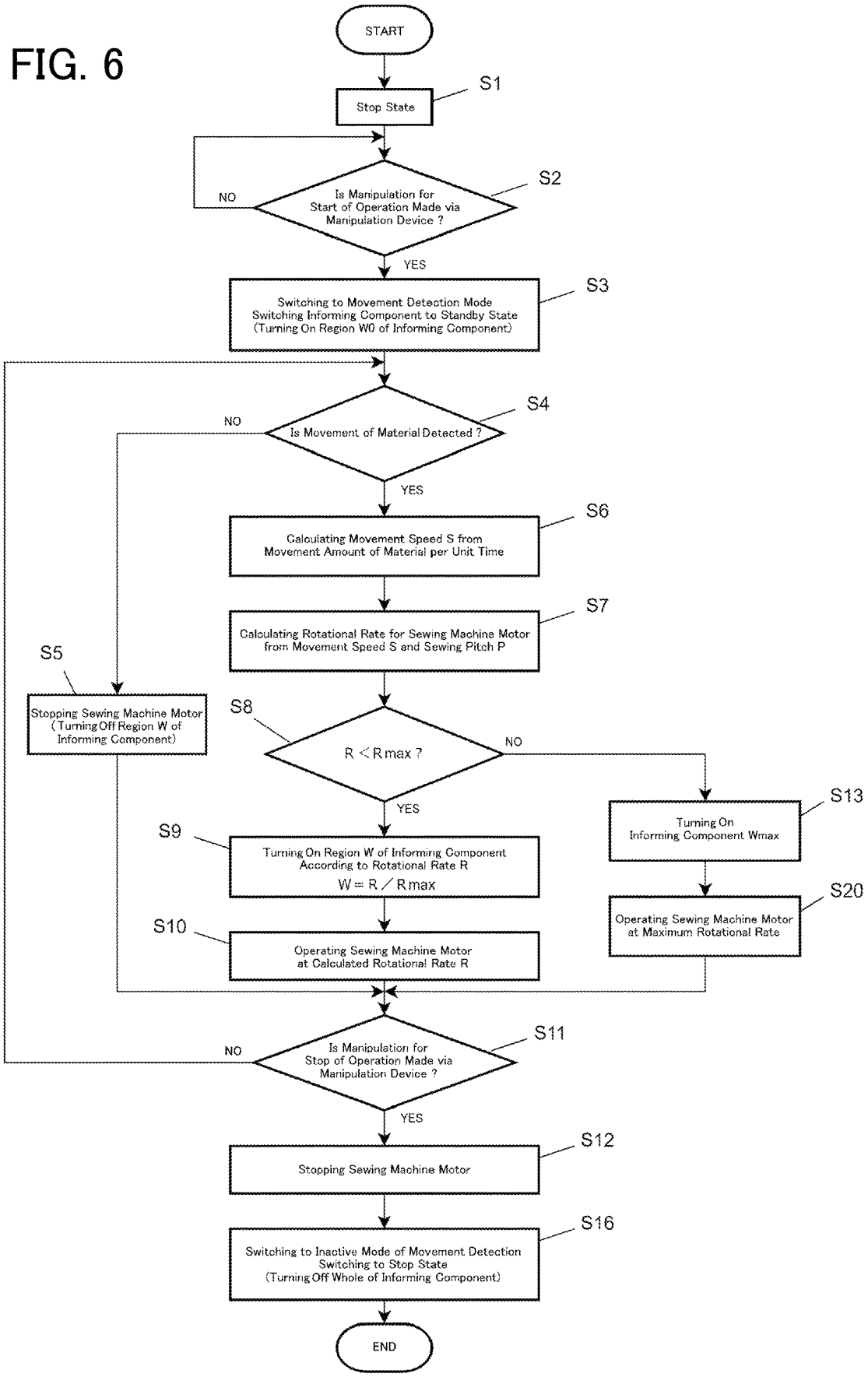
FIG. 6 shows an exemplary flowchart of Embodiment 2 of a control process implemented by the control unit.

FIG. 6 shows a flowchart illustrating a control process according to Embodiment 2. Steps S1 to S13 and S16 of the control process according to Embodiment 2 may be identical or similar to the corresponding steps of Embodiment 1described above. For this reason, Step S20 that is not included in Embodiment 1 will be mainly described hereinafter.

At Step S8, if the rotational rate R reaches or exceeds the maximum rotational rate Rmax (NO), the control unit 100, at Step S13, turns on the entire region W0+Wmax of the informing component 107. In Embodiment 1,the control unit 100 subsequently stop the sewing machine motor 106 (S14). However, in Example 2,the sewing machine motor 106 is operated at the maximum rotational rate Rmax and then Step S11 is implemented in order to continue the sewing (Step S20).

As the result of this process, in the control process according to Embodiment 2,if the movement speed S of the material exceeds the maximum movement speed Smax, it is possible to continue the sewing while it is hard to maintain the preset sewing pitch P. The control process according to Embodiment 1 is focused on the accuracy of a sewing pitch. In contrast, the control process according to Embodiment 2 is focused on the continuation of sewing. Either of these two control methods may be employed on the sewing machine 1, or alternatively, the sewing machine 1 may be configured to be switchable between these two control methods so that the user selects which methods to use via the manipulation device 101.

Embodiment 3 of a Control Process by the Control Unit

Figure 7:
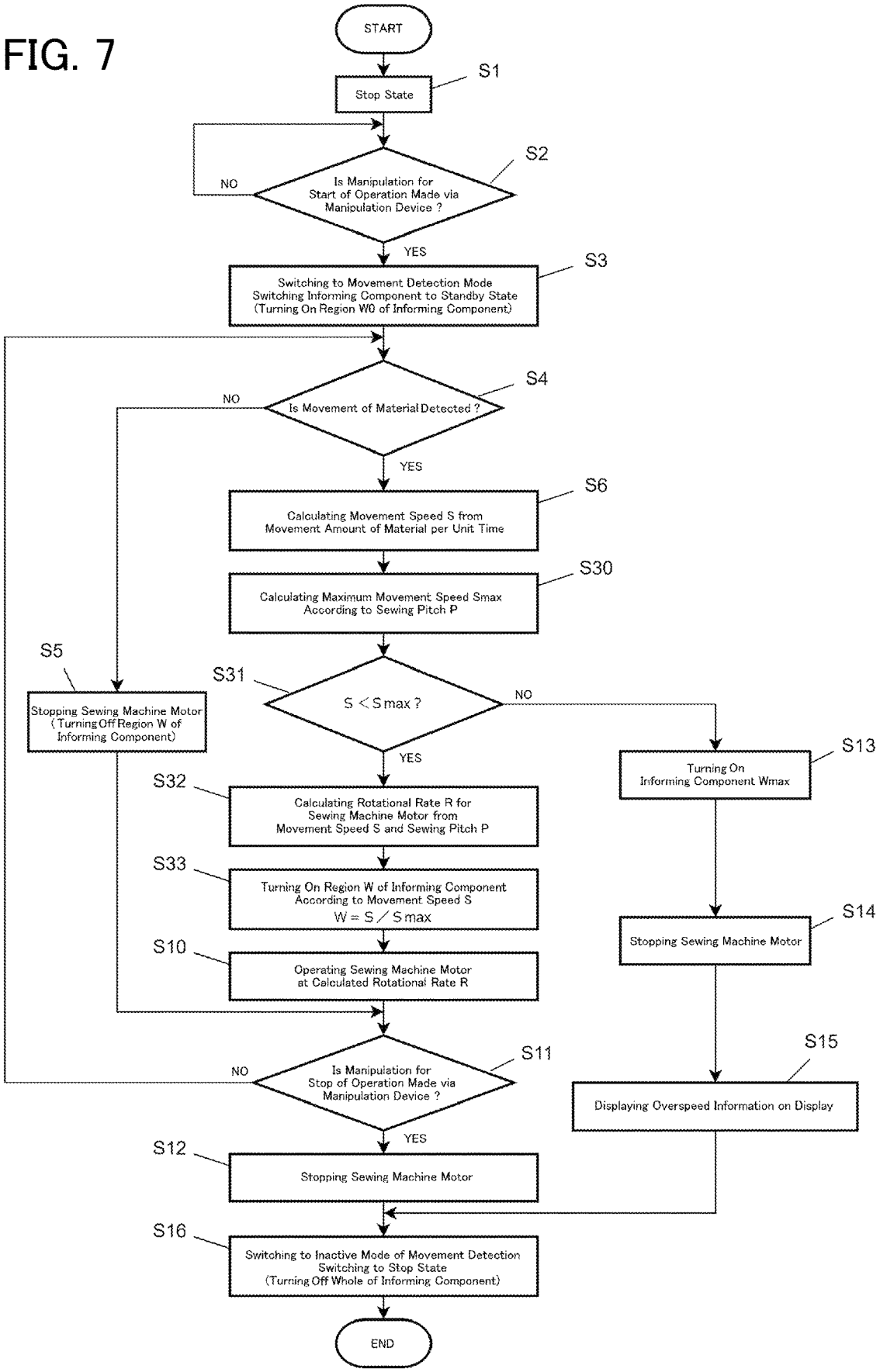
FIG. 7 shows an exemplary flowchart of Embodiment 3 of a control process implemented by the control unit.

FIG. 7 shows a flowchart illustrating a control process according to Embodiment 3. Embodiment 3 is a modification of Embodiment 1. In Embodiment 1, the speed monitoring region W (=R/Rmax) is calculated from the rotational rate R and the maximum rotational rate Rmax for the sewing machine motor 106. In Embodiment 3, the speed monitoring region W (=S/Smax) is calculated from the movement speed S of the material and the maximum movement speed Smax. Since the speed monitoring region W is R/Rmax=S/Smax as described above, both control processes according to Embodiments 1 and 3 have the same result (an increase or decrease and increase or decrease timing of the speed monitoring region W).

Steps S1 to S6 and S10 to S16 of the control process according to Embodiment 3 may be identical or similar to the corresponding steps of Embodiment 1 described above. For this reason, Steps S30 to S34 that are not included in Embodiment 1 will be mainly described hereinafter. At Step S6, the control unit 100 acquires a movement amount of the material per unit time from the detection signal of the movement detection unit 105 and then calculates the movement speed S of the material on the basis of the movement amount.

In Embodiment 1, the control unit 100 subsequently calculates the rotational rate R for the sewing machine motor 106 from the calculated movement speed S and the sewing pitch P (Step S7). Then, the control unit 100 monitors whether the rotational rate R reaches the maximum rotational rate Rmax (R<Rmax) (Step S8).

In Embodiment 3, the control unit 100 calculates the maximum movement speed Smax from the sewing pitch P preset by the sewing pitch setup unit 103 and the maximum rotational rate Rmax preset by the maximum value setup unit 104 (Step S30). Then, the control unit 100 monitors whether the movement speed S reaches the maximum movement speed Smax (S<Smax) (Step S31).

If the movement speed S does not reach the maximum movement speed Smax (YES), the control unit 100, at Step S32, calculates the rotational rate R for the sewing machine motor 106 from the movement speed S and the sewing pitch P. Then, at Step S33, the control unit 100 turns on the speed monitoring region W=S/Smax of the informing component 107 in accordance with the movement speed S ((3) shown in FIG. 4).

Embodiment 4 of a Control Process by the Control Unit

Figure 8:
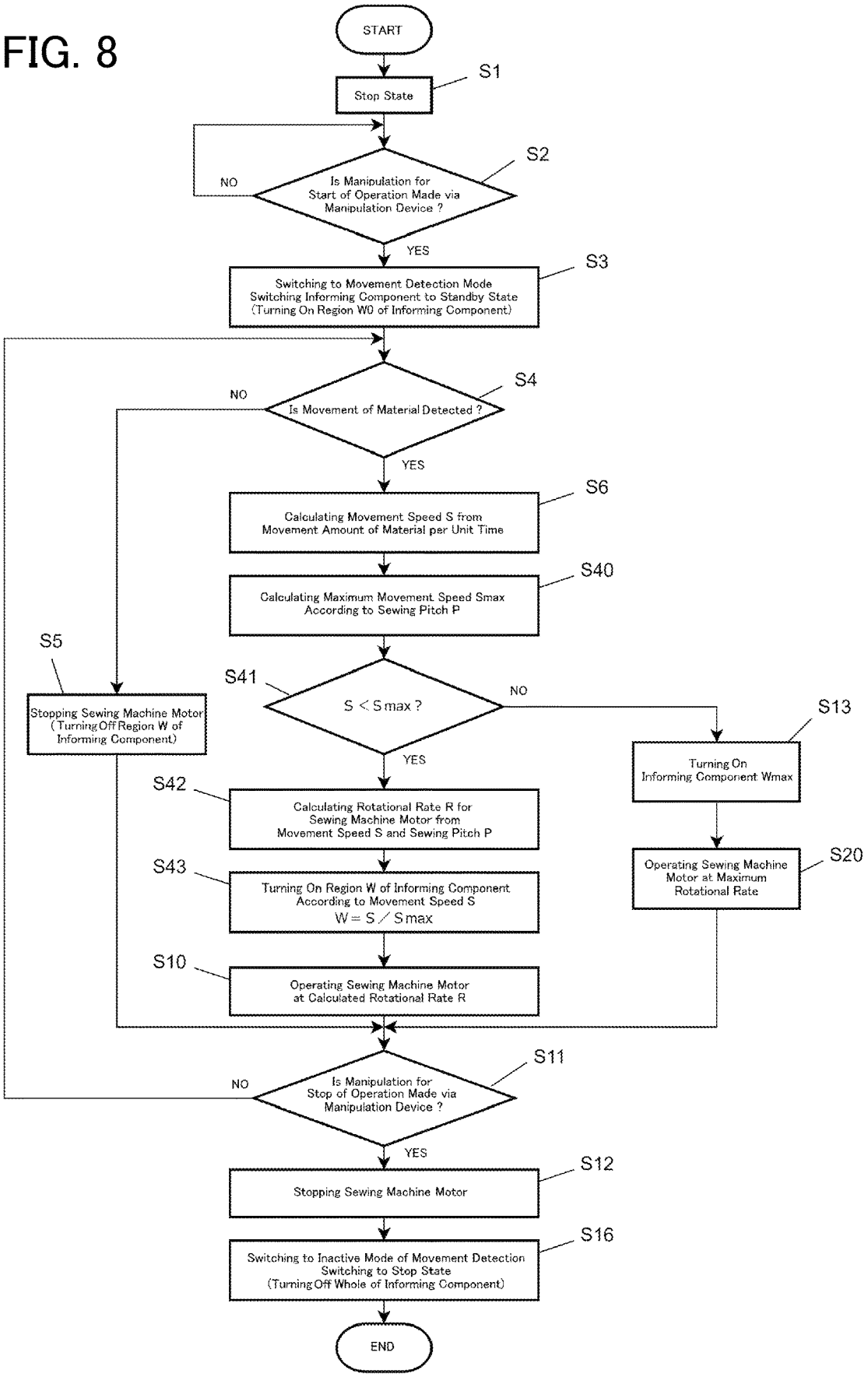
FIG. 8 shows an exemplary flowchart of Embodiment 4 of a control process implemented by the control unit.

FIG. 8 shows a flowchart illustrating a control process according to Embodiment 4. Embodiment 4 is a modification of Embodiment 2. In Embodiment 2, the speed monitoring region W(=R/Rmax) is calculated from the rotational rate R for the sewing machine motor 106 and the maximum rotational rate Rmax. In Embodiment 4, the speed monitoring region W (=S/Smax) is calculated from the movement speed S of the material and the maximum movement speed Smax. Since the speed monitoring region W is R/Rmax=S/Smax as described above, both control processes according to Embodiments 2 and 4 have the same result (an increase or decrease and increase or decrease timing of the speed monitoring region W).

Steps S1 to S6, S10 to S13, S16, and S20 of the control process according to Embodiment 4 may be identical or similar to the corresponding steps of Embodiment 1 or 2 described above. For this reason, Steps S40 to S43 that are not included in Embodiment 2will be mainly described hereinafter.

At Step S6, the control unit 100 acquires a movement amount of the material per unit time from the detection signal of the movement detection unit 105 and then calculates the movement speed S of the material on the basis of the movement amount.

In Embodiment 2,the control unit 100 subsequently calculates the rotational rate R for the sewing machine motor 106 from the calculated movement speed S and the sewing pitch P (Step S7). Then, the control unit 100 monitors whether the rotational rate R reaches the maximum rotational rate Rmax (R<Rmax) (Step S8).

In Embodiment 4, the control unit 100 calculates the maximum movement speed Smax from the sewing pitch P preset by the sewing pitch setup unit 103 and the maximum rotational rate Rmax preset by the maximum value setup unit 104 (Step S40). Then, the control unit 100 monitors whether the movement speed S reaches the maximum movement speed Smax (S<Smax) (Step S41).

If the movement speed S does not reach the maximum movement speed Smax (YES), the control unit 100, at Step S42, calculates the rotational rate R for the sewing machine motor 106 from the movement speed S and the sewing pitch P. At Step S43, the control unit 100 subsequently turns on the speed monitoring region W=S/Smax of the informing component 107 in accordance with the movement speed S ((3) shown in FIG. 4).

According to the embodiments above which have been described in reference to some examples, a user can grasp the current proportion of the rotational rate R to the maximum rotational rate Rmax for the sewing machine motor 106. Alternatively, a user can directly grasp the current proportion of the movement speed S to the maximum movement speed Smax of a material to be sewn. As a result, a user can stop sewing before making an uneven seam. Moreover, a user can move a material to be sewn without exceeding the maximum movement speed Smax, thereby creating a seam with a stable pitch.

The disclosed embodiments are not limited to the above-described examples, and may include various modifications. For example, the above-described examples have been described in detail for easy understanding of the embodiments, but the examples are not necessarily limited to those having all the described configurations. A component or components of some of the examples can be replaced with the component or components of another example, and a component or components of some of the examples can be added to one of the examples. For a component or components of the respective examples, the addition of different component(s), deletion or replacement can be made.

Some or all of the above-described configurations, functions, processing units, processing means, and the like may be implemented using hardware, for example, by designing with an integrated circuit. Alternatively, the above-described configurations, functions, and the like may be implemented using software executed by a processor interpreting and executing programs for implementing the respective functions. Information such as a program, a table, and a file for implementing each function can be stored in a storage such as a memory, a hard disk, and a solid state drive (SSD), or a recording medium such as an IC card, an SD card, and a DVD.

Connection line, control line, information line, etc. shows what are considered to be necessary for the explanation, not necessarily all on the product. In practice, almost all of the configurations may be considered to be connected to each other.

The above-described embodiments disclose at least the following concepts.

[1] A sewing machine 1 comprising:

a sewing pitch setup unit 103 configured to set up a given sewing pitch P;

a movement detection unit 105 configured to detect a movement of a material to be sewn;

a control unit 100 configured to calculate a movement speed S of the material on the basis of a movement amount of the material detected by the movement detection unit 105 and to calculate a rotational rate R for a sewing machine motor 106 for operating a needle 2 on the basis of the movement speed S and the given sewing pitch P; and an informing component 107 configured to inform of magnitude of the rotational rate R relative to the maximum rotational rate Rmax for the sewing machine motor 106.

[2] The informing component 107 is configured to inform of the magnitude of the rotational rate R relative to the maximum rotational rate Rmax by means of variations in display or variations in sound.

[3] The sewing machine 1 further comprises a maximum value setup unit 104 for setting up the maximum rotational rate Rmax.

[4] If the calculated rotational rate R exceeds the maximum rotational rate Rmax, the informing component 107 displays information or emits a sound for informing that the rotational rate R exceeds the maximum rotational rate Rmax.

[5] The control unit 100 is configured to stop the sewing machine motor 106 when the calculated rotational rate R exceeds the maximum rotational rate Rmax.

[6] The control unit 100 is configured to operate the sewing machine motor 106 at the maximum rotational rate Rmax when the calculated rotational rate R exceeds the maximum rotational rate Rmax.

[7] A computer program (or a computer program product or a computer-readable storage containing a program) for controlling a sewing machine 1, the sewing machine 1 comprising: a sewing machine motor 106 for operating a needle 2; a movement detection unit 105 for detecting a movement of a material to be sewn; a control unit 100 for operating the sewing machine motor 106, wherein, when implementing the computer program, the control unit 100 is operable to:

calculate a movement speed S of the material on the basis of a movement amount of the material detected by the movement detection unit 105;

calculate a rotational rate R for the sewing machine motor 106 on the basis of the movement speed S and a given sewing pitch P; and cause an informing component 107 to inform magnitude of the rotational rate R relative to a maximum rotational rate Rmax for the sewing machine motor 106.

The embodiments have been described with reference to several examples. However, other than the examples, various embodiments can be conceived on the basis of the scope understood in the above description.

What is claimed is:

1. A sewing machine comprising:

a sewing pitch setup unit configured to set up a given sewing pitch;

a movement detection unit configured to detect a movement of a material to be sewn;

a control unit configured to calculate a movement speed of the material on the basis of a movement amount of the material detected by the movement detection unit and to calculate a rotational rate for a sewing machine motor for operating a needle on the basis of the movement speed and the given sewing pitch; and an informing component configured to inform of a proportion of the rotational rate to a maximum rotational rate for the sewing machine motor.

2. The sewing machine according to claim 1, wherein the informing component is configured to inform by means of variations in display or variations in sound.

3. The sewing machine according to claim 1, further comprising a maximum value setup unit for setting up the maximum rotational rate.

4. The sewing machine according to claim 1, wherein, if the calculated rotational rate exceeds the maximum rotational rate, the informing component displays information or emits a sound for informing that the rotational rate exceeds the maximum rotational rate.

5. The sewing machine according to claim 1, wherein the control unit is configured to stop the sewing machine motor when the calculated rotational rate exceeds the maximum rotational rate.

6. The sewing machine according to claim 1, wherein the control unit is configured to operate the sewing machine motor at the maximum rotational rate when the calculated rotational rate exceeds the maximum rotational rate.

7. A non-transitory computer-readable storage medium containing computer-executable instructions for controlling a sewing machine, the sewing machine comprising: a sewing machine motor for operating a needle; a movement detection unit for detecting a movement of a material to be sewn; and a control unit for operating the sewing machine motor, wherein, when implementing the instructions, the control unit is operable to:

calculate a movement speed of the material on the basis of a movement amount of the material detected by the movement detection unit;

calculate a rotational rate for the sewing machine motor on the basis of the movement speed and a given sewing pitch; and cause an informing component to inform of a proportion of the rotational rate to a maximum rotational rate for the sewing machine motor.

* * * * *